US007744738B1

(12) United States Patent
Gagnon et al.

(10) Patent No.: US 7,744,738 B1
(45) Date of Patent: Jun. 29, 2010

(54) METHOD AND APPARATUS FOR RAPID PARTICLE MANIPULATION AND CHARACTERIZATION

(75) Inventors: Zachary Gagnon, Notre Dame, IN (US); Hsueh-Chia Chang, Granger, IN (US)

(73) Assignee: The University of Notre Dame, Notre, Dame, IN (US)

( * ) Notice: Subject to any disclaimer, the term of this patent is extended or adjusted under 35 U.S.C. 154(b) by 1461 days.

(21) Appl. No.: 11/117,632

(22) Filed: Apr. 29, 2005

Related U.S. Application Data

(63) Continuation-in-part of application No. 10/965,781, filed on Oct. 18, 2004.

(60) Provisional application No. 60/511,364, filed on Oct. 16, 2003, provisional application No. 60/563,002, filed on Apr. 19, 2004.

(51) Int. Cl.
*B03C 5/02* (2006.01)

(52) U.S. Cl. ..... 204/643; 204/600

(58) Field of Classification Search ..... 204/600, 204/643

See application file for complete search history.

(56) References Cited

U.S. PATENT DOCUMENTS

| | | | | |
|---|---|---|---|---|
| 6,256,533 | B1 | 7/2001 | Yuzhakov et al. | |
| 6,743,211 | B1 | 6/2004 | Prausnitz et al. | |
| 6,749,735 | B1 | 6/2004 | Le Febre | |
| 6,883,337 | B2 | 4/2005 | Shyy et al. | |
| 7,235,164 | B2 * | 6/2007 | Anex et al. | 204/600 |
| 2002/0099356 | A1 | 7/2002 | Unger et al. | |
| 2002/0198512 | A1 | 12/2002 | Seward | |
| 2003/0127329 | A1 | 7/2003 | DeVoe et al. | |
| 2004/0200724 | A1 | 10/2004 | Fujii et al. | |
| 2004/0226819 | A1 | 11/2004 | Talary et al. | |

FOREIGN PATENT DOCUMENTS

DE 19544127 C1 * 3/1997

OTHER PUBLICATIONS

Sample, et al., "Production of Liquid Aerosols by Harmonic Electrical Spraying" Journal of Colloid and Interface Science, 41 (2) (Nov. 1972) p. 185-193.

Sato, Masayuki, "The Production of Essentially uniform-Sized Liquid Droplets in Gaseous or Immiscible Liquid Media Under Applied A.C. Potential" Journal of Electrostatics, 15 (1984) p. 237-247.

Secker, et al., "A Simple Liquid-Immersed Dielectric Motor" Journal of Applied Physics, 39 (6) (May 1968) p. 2957-2961.

(Continued)

*Primary Examiner*—Nam X Nguyen
*Assistant Examiner*—J. Christopher Ball
(74) *Attorney, Agent, or Firm*—Ladas & Parry LLP

(57) ABSTRACT

The present invention provides a method and apparatus for use in rapid particle transportation, separation, focusing, characterization, and release. Dielectrophoresis and electro-osmotic driven fluid convection are used independently or in tandem as the driving forces for particle manipulation and on occasion characterization. Although dielectrophoresis has been acknowledged for decades as a powerful technique for particle manipulation and characterization, long processing times and measurement inaccuracies that emerge from using disjointed electrodes have limited its usefulness in diagnostic kits. The present invention provides for a continuous wire that enables fluid flow patterns and dielectrophoretic forces with optimal configurations for rapid and sensitive particle manipulation and characterization.

45 Claims, 8 Drawing Sheets

OTHER PUBLICATIONS

Squires, et al., "Induced-Charge Electro-Osmosis" Journal of Fluid Mechanics, 509 (2004) p. 217-252.
Stoy, Richard, "Solution Procedure for the Laplace Equation in Bispherical Coordinates for Two Spheres in a Uniform External Field: Parallel Orientation" Journal of Applied Physics, 65 (7) (Apr. 1989) p. 2611-2615.
Stoy, Richard, "Solution Procedure for the Laplace Equation in Bispherical Coordinates for Two Spheres in a Uniform External Field: Perpendicular Orientation" Journal of Applied Physics, 66 (10) (Nov. 1989) p. 5093-5095.
Studer, et al., "Fabrication of Microfluidic Devices for AC Electrokinetic Fluid Pumping" Microelectronic Engineering, 61-62 (2002) p. 915-920.
Suehiro, et al., "Selective Detection of Viable Bacteria Using Dielectrophoretic Impedance Measurement Method" Journal of electrostatics, 57 (2003) p. 157-168.
Suehiro, et al., "High Sensitive Detection of Biological Cells Using Dielectrophoretic Impedance Measurement Method Combined with Electropermeabilizaiton" Sensors and Actuators B, 96 (2003) p. 144-151.
Suehiro, et al., "Selective Detection of Specific Bacteria Using Dielectrophoretic Impedance Measurement Method Combined with an Antigen-Antibody Reaction" Journal of Electrostatics, 58 (2003) p. 229-246.
Suzuki, et al., "Dielectrophoretic Micropatterning with Microparticle monolayers Covalently Linked to glass Surfaces" Langmuir, 20 (2004) p. 11005-11011.
Takhistov, et al., "Electrokinetic Displacement of Air Bubbles in Microchannels" Physics of fluids, 14 (Jan. 2002) p. 1-14.
Thorsen, et al., "Dynamic Pattern Formation in a Vesicle-Generating Microfluidic Device" Physical Review Letters, 86 (18) (Apr. 2001) p. 4163-4166.
Turner, James N., "AC Electrokinetic Tools for the Manipulation of Bioparticles" CNF Project #1197-04.
Ulander, et al., "Primary and Secondary Effective Charges for Electrical Double Layer systems with Asymmetric Electrolytes" Journal of Chemical Physics, 115 (15) (Oct. 2001) p. 7144-7160.
Veretennikov, et al., "Mechanism for Helical Gel Formation from Evaporation of Colloidal Solutions" Langmuir, 18 (2002) p. 8792-8798.
Wang, et al., "Dependence of Buffer Acidity and Ion Size on Electro-Osmotic mobility in Surfactant-Coated Silica Microchannels".
Wang, et al., "A Theoretical Method of Electrical Field Analysis for Dielectrophoretic electrode Arrays Using Green's Theorem" J. Phys. D: Applied Physics, 29 (1996) p. 1649-1660.
Wong, et al., "Electrokinetics in Micro Devices for Biotechnology Applications" IEEE/ASME Transaction on Mechantronic (2003).
Yeo, et al., "A New AC Electrospray Mechanism by Maxwell-Wagner Polarization and Capillary Resonance" Physical Review Letters, 92 (13) (Apr. 2004) p. 133902.
Yuzhakov, et al., "Pattern Formation During Electropolishing" Physical Review B, 56 (19) (Nov. 1997) p. 12608-12624.
Ajdari, Armand, "Electro-Osmosis on Inhomogeneously Charged Sufraces" The American Physical Society, 75(4) (Jul. 1995) p. 755-759.
Ajdari, Armand, "Pumping liquids using asymmetric electrode arrays" The American Physical Society, 61(1) (Jan. 2000) p. R45-R48.
Ajdari, Armand, "Transverse Electrokinetic and Microfluidic Effects in Micropatterned Channels: Lubrication Analysis for Slab Geometrics" The American Physical Society, 65 (2001) p. 65 016301-1-65 016301-9.
Asmolov, Evgeny, "The Inertial Lift on a Small Particle in a Weak-Shear Parabolic Flow" Physics of Fluids, 14(1) (Jan. 2002) p. 15-28.
Barcilon, et al., "Qualitative Properties of Steady-State Poisson-Nernst-Planck Systems: Perturbation and Simulation Study" Journal of Applied Math, 57(3) (Jun. 1997) p. 631-648.
Bazant, et al., "Current-Voltage Relations for Electrochemical Thin Films".
Bazant, et al., "Diffuse-Charge Dynamics in Electrochemical Systems".
Bazant, et al., "Induced-Charge Electrokinetic Phenomena: Theory and Microfluidic Applications" Physical Review Letters 92(6) (Feb. 2004) p. 066101-1-066101-4).
Ben, et al., Linear Particle Assembly and Erasure by AC Electro-osmotic Flow: Effects of Faradaic and Capacitive Charging.
Bonnefont, et al.,"Asymptotic Analysis of Diffuse-Layer Effects on Time-Dependent Interfacial Kinetics" (Apr. 2004).
Borra, J.P., et al., Influence of electric Field Profile and Polarity on the Mode of EHDA Related to Electric Discharge Regimes J. of aerosol Science, 30(7) (1999) p. 913-925.
Brown, et al., "Pumping of Water with AC Electric Fields Applied to asymmetric Pairs of Microelectrodes" Physical review E, 63 (2000) p. 016305.
Chen, et al., "Dynamics of Inviscid Capillary Breakup: Collapse and Pinchoff of a Film Bridge" J. of Fluid Mechanics 341 (1997) p. 245-267.
Chiou, et al., "Light actuation of Liquid by Optoelectrowetting" Sensors and Actuators, 104 (2003) p. 222-228.
Chu, et al., "Electrochemical Thin Films at and Above the Classical Limiting Current".
Chun, et al., "The Electroviscous Force Between Charged Particles: Beyondthe Thin-Double-Layer approximation" Journal of Colloid and Interface Science, 274 (2004) p. 687-694.
Cloupeau, et al., "EHD Spraying Functioning Modes" (1032-1036).
Cohen, et al., "Shear-Induced Configurations of Confined Colloidal suspensions" Physical Review Letters, 93(4) (Jul. 2004) p. 046001-1-046001-4.
Deval, et al., "ADielectrophoretic Chaotic Mixer" (2002) p. 36-39.
Dinsmore, et al., "Colloidosomes: Selectively Permeable Capsules Composed of Colloidal Particles" Science 298 (Nov. 2002) p. 1006-1009.
Dukhin, S.S., "Non-equilibrium Electric Surface Phenomena" Advances in Colloid and Interface Science, 44 (1993) p. 1-134.
Eggers, Jens, "Universal Pinching of 3D axisymmetric Free-Surface Flow" Physical Review Letters, 71(21) (Nov. 1993) p. 3458-3460.
Eggleton, et al., "Tip Stream from a Drop in the Presence of Surfactants" Physical Review Letters, 87(4) (Jul. 2001) p. 048302.
Eloot, Sunny, "Experimental Evaluation of the Migration of Spherical Particles in Three-Dimensional Poiseuille Flow" Physics of Fluids, 16(7) (Jul. 2004) p. 2282-2293.
Feng, et al., "Interparticle Forces and Lift on a Particle Attached to a Solid Boundary in Suspension Flow" Physics of Fluids 14(1) (Jan. 2002) p. 49-60.
Fenn, et al., "Electrospray Ionization for Mass Spectrometry of Large Biomolecules" Science 246 (Oct. 1989) p. 64-71.
Gamero-Castano, et al., "Kinetics of Small Ion Evaporation from the Charge and Mass Distribution of Multiply Charged Clusters in Electrosprays" J. of Mass Spectrometry, 35 (2000) p. 790-803.
Gamero-Castano, et al., "Electric Measurements of Charged Sprays Emitted by Cone-Jets" J. fluid Mechanics, 459 (2002) p. 245-276.
Gamero-Castano, Manuel, "Electric-Field-Induced Ion Evaporation from Dielectric Liquid" Physical Review Letters 89(14) (Sep. 2002) p. 147602.
Gascoyne, et al., "Dielectrophoresis-Based Sample Handlinig in General-Purpose Programmable Diagnostic Instruments" Proceedings of the IEEE 92(1) (Jan. 2004) p. 22-42.
Gonzalez, et al., "fluid Flow Induced by Nonuniform AC Electric fields in Electrolytes on Microelectrodes. II. A Linear Double-Layer Analysis" Physical review E, 61(4) (Apr. 2000) p. 4019-4028.
Goranovic, Goran, "Electrohydrodynamic aspects of Two-fluid Microfluidic Systems: Theory and Simulation" Ph.D. Thesis (2003).
Grace, et al., "A Review of Liquid Atomizaiton by Electrical Means" J. of aerosol Science, 25(6) (1994) p. 1005-1019.
Grahame, David, "The electrical Double Layer and the Theory of Electrocapillarity".
Green, et al., "Fluid Flow Induced by Nonuniform AC Electric Fields in Electrolytes on Microelectrodes. I. experimental Measurements" Physical Review E, 61(4) (Apr. 2000) p. 4011-4018.
Ijsebaert, et al., "Electro-Hydrodynamic Atomization of Drug solutions for Inhalation Purposes" J. of applied Physiology, 91 (2001) p. 2735-2741.
Jones, et al., "active Feedback-Controlled Dielectrophoretic Levitation" J. of applied Physiology 60(4) (Aug. 1986) p. 1247-1252.

Kazoe, et al., "Measurements of electric Double Layer Between Electrolyte-Glass Interface by Evanescent Wave Light Illumination".

Lapizco-Encinas, et al., "Insulator-Based Dielectrophoresis for the selective Concentration and Separation of Live Bacteria in Water" Electrophoresis, 25 (2004) p. 1695-1704.

Lastochkin, et al., "Electro-Kinetic Micro-Pump and Micro-Mixer Design on AC Faradaic Polarization" (2004).

Lauga, et al., "Evaporation-Driven Assembly of colloidal Particles" Physical Review Letters, 93 (2004) p. 238301.

Locke, Bruce, "Gas-Liquid Electrical Discharge Reactor Analysis" Proposal to the National Science Foundation (Jan. 2005).

Long, et al., "Electroosmotic flows Created by Surface Defects in Capillary Electrophoresis" J. of Colloid and Interface Science 212 (1999) p. 338-349.

Loscertales, et al., "Micro/Nano Encapsulation Via electrified coaxial Liquid jets" Science, 295 (Mar. 2002) p. 1695-1698.

Low, Peter, "Optimization of electrode Structures for DEP Microfluidic actuation: Application to Cantilever-Based Biological Sample Depositions" (Oct. 2003).

Luu, et al., "Characterization of an Electrospun Poly(Lactide-co-glycolide) and Block copolymer-Based Nanaostructured Matrix for DNA Delivery".

Meiners, et al., "Direct Measurement of Hydrodynamic Cross Correlations Between Two particles in an External Potential" Physical review Letters, 82(10) (Mar. 1999) p. 2211-2214.

Meinhart, et al., "Measurement of AC Electrokinetic Flows" J. of Biomedical Microdevices, 5(2) (2003) p. 141-147.

Merkel, et al., "electric fields in Fluidic Channels and Sensor applications with Capacitance" Sensors and Actuation, 80 (2000) p. 1-7.

Minerick, et al., "Manipulation and Characterization of Red Blood Cells with Alternating Current fields in Microdevices" Electrophoresis, (24) (2003) p. 3703-3717.

Mortensen, et al., "electro-Hydrodynamics of Bi-Ionic Electrolytes Driven by Modulated Surfaces" (2004).

Mpholo, et al., "Low Voltage Plug flow pumping Using Anisotropic electrode arrays" Sensors and Actuators, 92 (2003) p. 262-268.

Nadal, et al., "Eletrically Induced flows in the Vicinity of a dielectric stripe on a conducting plane" The European Physical Journal E, 9 (2002) p. 387-399.

Ogawa, Tomoya, "Measurement of the electrical conductivity and dielectric constant without contacting electrodes" J. of Applied Physics, 32(4) (1961) p. 583-592.

Okonski, Chester, "Electric properties of macromolecules. V. Theory of ionic polarization in polyelectrolytes" Theory of ionic Polarization in Plyelectrolytes (1960).

Ostubo, et al., "Dielectric Fluid Motors" applied Physics Letters, 71(3) (Jul. 1997) p. 318-320.

Papageorgiou, Demetrios, "On the Breakup of Viscous Liquid Threads" Phys. Fluids 7(7) (Jul. 1995) p. 1529-1544.

Pawlowski, et al., "Electrospun Electroactive Polymers for Aerospace Applications" American Institute of Aeronautics and Astronautics.

Ramos, et al., "AC Electrokinetics: A Review of Forces in Microelectrode Structures" J. Phys. D: Applied Physics, 31 (1998) p. 2338-2353.

Ramos, et al., "AC Electric-Field-Induced Fluid Flow in microelectrodes" Letter to the Editor, Journal of Colloid and Interface Science, 217 (1999) p. 420-422.

Radzihovsky, et al., "Novel Phases and Reentrant Melting of Two-Dimensional Colloidal Crystals" Physical Review E, 63 (2001) p. 031503.

Ramos, et al., "Pumping of Liquids with AC Voltages Applied to Asymmetric Pairs of Microelectrodes" Physical Review E, 67 (2003) p. 056302.

Rice, et al., "Electrokinetic Flow in a Narrow Cylindrical Capillary" The Journal of Physical Chemistry, 69 (11) (Nov. 1965) p. 4017-4024.

Zarraga, et al., "The Characterization of the Total Stress of Concentrated suspensions of Noncolloidal Spheres in Newtonian Fluids" Journal of Rheaology, 44 (2) (Mar./Apr. 2000) p. 185-220.

Zarraga, et al., "Normal Stress and Diffusion in a Dilute suspension of Hard Spheres Undergoing Simple Shear" Physics of Fluids, 13 (3) (Mar. 2001) p. 565-577.

Zarraga, et al., "Measurement of an Unexpectedly Large Shear-induced Self-Diffusivity in a Dilute Suspension of Spheres" Physics of Fluids, 14 (7) (Jul. 2002) p. 2194-2201.

Gomez, Alessandro, "The electrospray and its Application to Targeted Drug Inhalation" Abstract, Respiratory Care Journal 47 (12) (Dec. 2002).

* cited by examiner t=0 seconds t=10 seconds t=20 seconds t=30 seconds
STAGNATION REGION

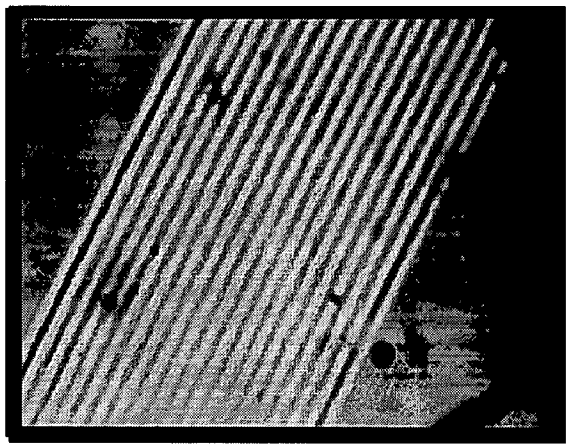
FIG. 7A t=0 seconds
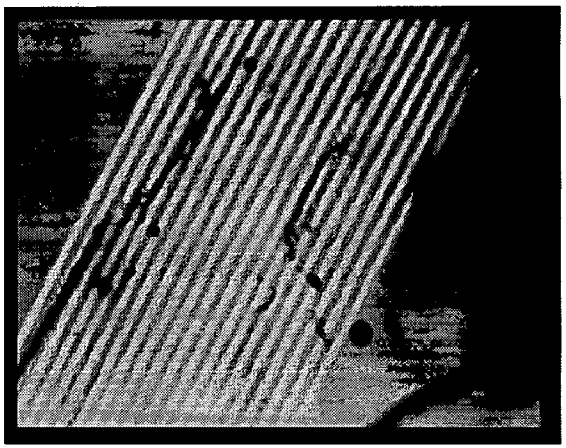
FIG. 7B t=0.07 seconds
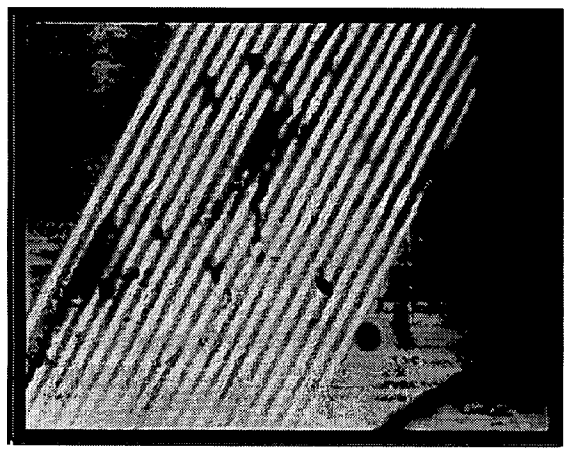
FIG. 7C t=0.14 seconds
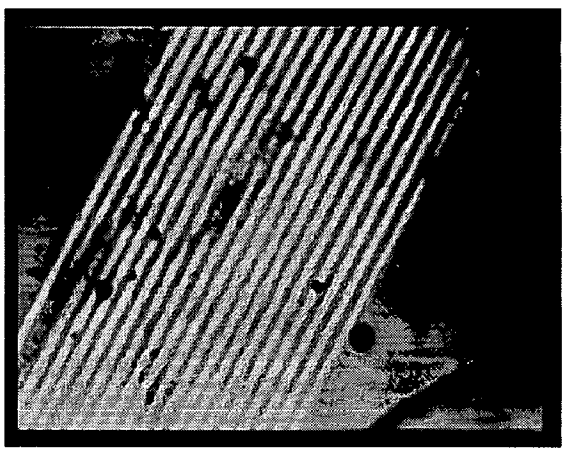
FIG. 7D t=1 seconds

METHOD AND APPARATUS FOR RAPID PARTICLE MANIPULATION AND CHARACTERIZATION

CROSS-REFERENCE TO RELATED APPLICATIONS

This application is a continuation-in-part of co-pending U.S. patent application Ser. No. 10/965,781, entitled "Method and Apparatus for AC Micropump," filed Oct. 18, 2004, which claims the benefit of U.S. Provisional Patent Application No. 60/511,364, entitled "High-Frequency AC Micro-fluidic Pump with Orthogonal Electrodes," filed Oct. 16, 2003, and U.S. Provisional Patent Application No. 60/563,002, entitled "Biased Electrochemical Micropump/Mixer," filed Apr. 19, 2004. The above applications are hereby incorporated by reference herein in their entirety.

BACKGROUND

1. Field of the Invention

The present invention relates generally to microfluidic components for diagnostic kits and, more particularly, to methods and devices for manipulation and characterization of particles with alternating current (AC) electric fields.

2. Related Art

Dielectrophoretic analysis and separation of particles and bioparticles such as cells, viruses, proteins and DNA using alternating current (AC) and direct current (DC) electric fields are potentially powerful microfluidic technologies that can be used in medical and environmental diagnostic kits and high-throughput drug screening. Recent development efforts have tried to exploit dielectrophoresis for particle transportation, separation, focusing, characterization and release. For medical and environmental diagnostic kits, the goal would be to rapidly concentrate, identify and determine the viability of pathogens in dilute samples with less than one thousand bioparticles per cc.

A plethora of approaches with disjointed electrode designs have not been able to employ dielectrophoresis with the necessary speed to attain the rapid processing time that chip-based diagnostics require. The greatest challenge is that the velocity imparted on a particle via dielectrophoresis scales as the second power of both the particle radius and the electric field, meaning that high electric fields are necessary for rapid particle manipulation. Unfortunately, even with micro-fabricated electrodes the field is typically less than 100 V/cm. This is because with conventional inter-digitated and disjointed electrode designs the electrode RMS voltage cannot exceed 5V due to Faradaic electrochemical reactions that contaminate samples and lead to bubble generation. Consequently, with disjointed electrodes a typical velocity imparted on a particle via dielectrophoresis is less than 10 microns per second. Therefore, manipulation and characterization must be carried out in extremely small channels (<100 microns) in order to be completed in a reasonable time frame.

The physical limitations of using disjointed electrodes results in long processing times for typical sample sizes and can ultimately lead to errant measurements despite the long wait. The slow dielectrophoretic motion requires the use of confined geometries or waiting tens of minutes to hours for processing a larger volume. The challenges associated with characterizing particles with disjointed electrodes arise from electro-osmotic flow that often occurs near the electrode surfaces. If the device is to measure a property of the particle based upon its dielectrophoretic motion, electro-osmotic flow could camouflage the behavior of the particle that is driven by dielectrophoretic motion alone. Regardless of the chosen application, the key problem that arises is that the throughput for processing steps that make use of dielectrophoresis is limited to the range of picoliters to nanoliters per second when disjointed electrodes are employed. This throughput is inadequate for rapid diagnostic applications of dielectrophoresis, which require rapid (<1 minute) particle manipulation and analysis of realistic sample volumes that range from 0.1 to 1.0 milliliters.

SUMMARY

According to a first broad aspect of the present invention, there is provided a device for rapid particle transportation, separation, focusing, characterization and release comprising a continuous conducting wire, a medium in contact with the wire that is nonconductive or less conductive than the wire; and a source in electrical communication with the wire and for generating an alternating current across the wire, the source being selectively adjustable to generate a frequency between approximately 100 hertz and approximately 10 megahertz inclusive and an RMS voltage between approximately 0.1 volts and approximately 3000 volts inclusive.

In embodiments of this aspect of the present invention, the continuous serpentine conducting wire has substantially parallel straights are spaced apart by between 10 nanometers and 3 centimeters. The wire may be at least partially covered with packing, porous media, or monoliths having pore sizes from approximately 1 nanometer to approximately 10 micrometers. In certain embodiments, the continuous conducting wire is arranged in a spiral configuration.

According to other embodiments of the present invention, the medium is a dielectric liquid, an electrolyte, or a mixture of dielectric liquids and electrolytes. Alternatively, the medium may be a solid substrate to which the continuous wire is affixed, or a combination of one or more substrates with one or more fluids.

According to another broad aspect of the present invention, there is provided a method for rapid particle transportation, separation, focusing, characterization, and or release comprising: the steps of providing a continuous conducting wire; providing a medium in contact with the continuous conducting wire that is less conductive than said wire; providing a fluid in contact with the continuous conducting wire and the medium, applying an alternating current across the continuous conducting wire with a frequency between approximately 100 hertz and approximately 10 megahertz, inclusive and an RMS voltage between approximately 0.1 volts and approximately 3000 volts, inclusive. The medium may be, for example, a dielectric liquid, an electrolyte or a mixture of dielectric liquids and electrolytes, alternatively, maybe, a fluid comprising proteins, bacteria, cells, viruses, DNA, or colloids ranging from 10 nanometers to 100 micrometers in diameter.

In one embodiment, the continuous conducting wire is at least partially coated with a dielectric film.

In certain embodiments, the optical observation of the effect of the AC source, the continuous conducting wire, and the medium on said fluid is used as a metric for characterization of a part of said fluid.

According to another aspect of the invention, a method is provided for focusing a first subset of particles within a mixture of particles, comprising the steps of providing a continuous conducting wire, providing a medium in contact with the continuous conducting wire that is less conductive than the wire, providing a fluid in contact with the continuous conducting wire and the medium; and a first focusing step comprising applying an alternating current across the continuous conducting wire with a frequency between 100 hertz and 10 megahertz and a RMS voltage between 0.1 volts and 3000 volts, such that a first subset of particles are focused within a first region of said fluid.

BRIEF DESCRIPTION OF THE DRAWINGS

Embodiments of the invention will be described in conjunction with the accompanying drawings, in which:

FIGS. 7A, 7B, 7C and 7D show the rapid release of a subset of particles focused to a highly concentrated region by reversal of their dielectrophoretic mobility using the device and method of the present invention.

DETAILED DESCRIPTION

Figure 1:
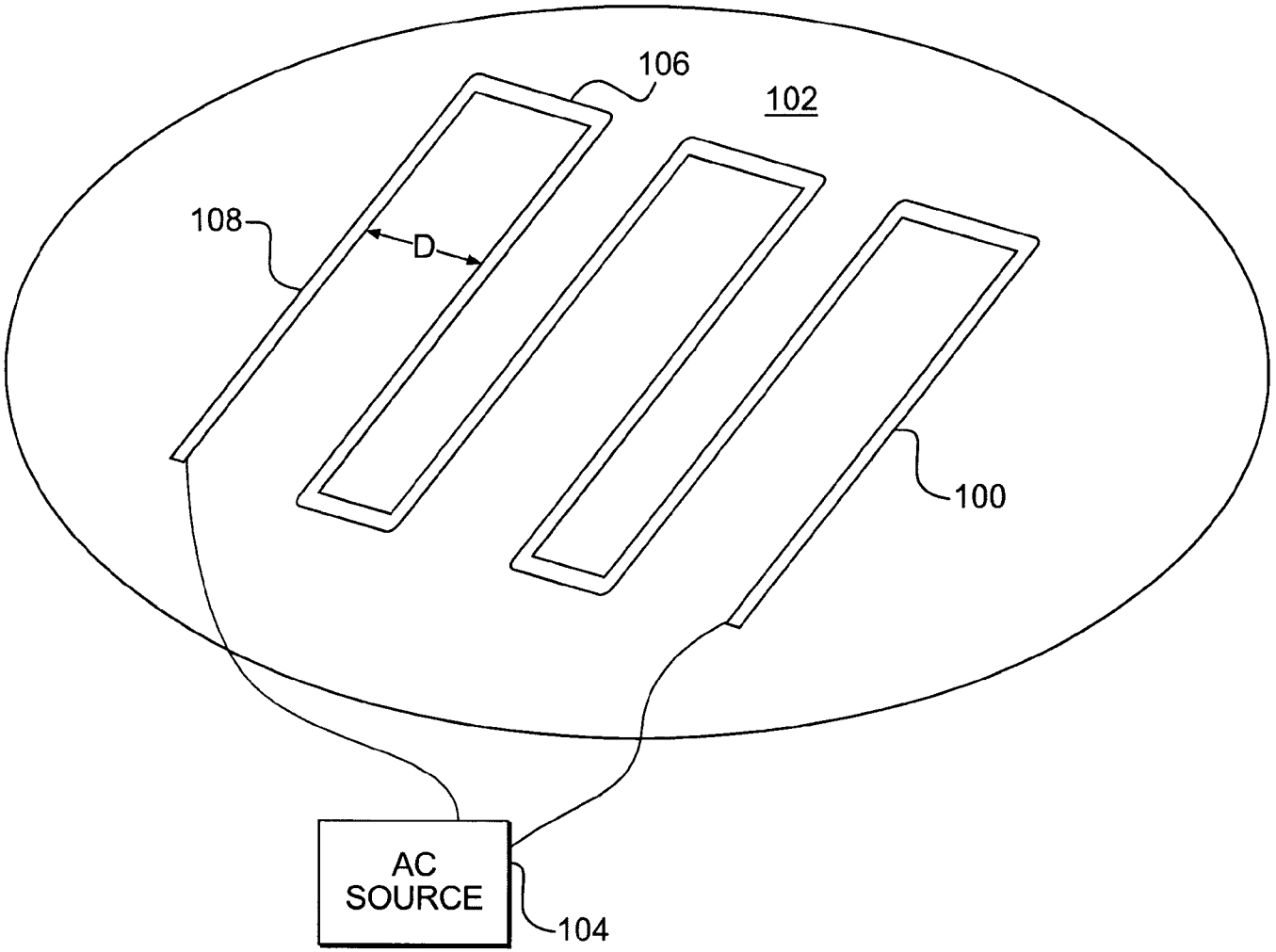
FIG. 1 shows a continuous wire with a serpentine orientation in accordance with an embodiment of the present invention.

It is advantageous to define several terms before describing the invention. It should be appreciated that the following definitions are used throughout this application.

DEFINITIONS

Where the definition of terms departs from the commonly used meaning of the term, applicant intends to utilize the definitions provided below, unless specifically indicated.

For the purposes of the present invention, the term "independent parameters" refers to the variables that may be adjusted to yield different particle behavior in the present invention. Specifically, these parameters are, but not limited to: fluid composition, fluid conductivity, fluid pH, fluid temperature, composition of the medium in contact with the wire, temperature of the medium, continuous wire composition, continuous wire configuration, continuous wire length, AC source frequency, AC source RMS voltage, particle composition, and particle concentration.

For the purposes of the present invention, the term "Faradaic reactions" refers to electrochemical reactions that result in contamination of a sample solution and undesirable bubble generation.

For the purposes of the present invention, the term "positive dielectrophoretic mobility" refers to a property of a particle, given a set of independent parameters, that results in its transport toward a region of high AC electric field.

For the purposes of the present invention, the term "negative dielectrophoretic mobility" refers to a property of a particle, given a set of independent parameters, that results in the particle's transport toward a region of low AC electric field.

For the purposes of the present invention, the term "pDEP" refers to positive dielectrophoretic mobility.

For the purposes of the present invention, the term "nDEP" refers to negative dielectrophoretic mobility.

For the purposes of the present invention, the term "zero force point" or "crossover frequency" refers to the frequency at which the particle transitions from pDEP to nDEP (or vice versa) where all other independent parameters are held constant.

For the purposes of the present invention, the term "stagnation region" refers to the region at which a recirculating fluid no longer acts to transport particles via fluid convection providing a force such as dielectrophoresis holds the particle in place. Stagnation regions develop, for example, at and/or near where the fluid velocity is zero.

For the purposes of the present invention, the term "focus" refers generally to the grouping of a subset of particles within a mixture of particles, within a region, such as a stagnation region.

For the purposes of the present invention, the term "release" as applied to a subset of particles within a stagnation region, refers to the movement of said subset of particles by changing at least one parameter of a force that holds said subset of particles within a stagnation region.

For the purposes of the present invention, the term "serpentine orientation" refers to an arrangement of an element, such as wire, such that the element spirals, winds or turns without crossing itself.

For the purposes of the present invention, the term "Maxwell force" refers to the electrical force on a liquid resulting from the combination of a net charge density and an electric field on and near a conducting surface.

For the purposes of the present invention, the term "local" refers to a region in which an embodiment of the present invention transports or holds stationary particles by dielectrophoresis or convection. The boundaries of such a region are where the device and method of the present invention cease to substantially influence particle motion.

For the purposes of the present invention, the term "global" refers to a region that is comprised of a region that is at least sometimes local and at least some additional volume. The boundaries of such a region are specified on an arbitrary basis. An example of what is meant by such a region is the entire microfluidic network on a chip-based diagnostic.

For the purposes of the present invention, the term "sequential batch" refers to a separation procedure conducted with a single device that is an embodiment of the present invention by running it twice under two different operating conditions. The sequential batch process uses a binary separation technique twice to obtain a single target species. The first separation step removes a group of particles that do not include the target species. In the second step only the target species fall into one bin while all of the remaining species are in another bin and are discarded.

DESCRIPTION

Dielectrophoretic analysis and separation of particles and bioparticles such as cells, viruses, proteins, and DNA using alternating current (AC) and direct current (DC) electric fields are potentially powerful microfluidic technologies that can be used in medical and environmental diagnostic kits and high-throughput drug screening. The reader is referred to the following articles for a further background on this subject: Pohl, H. A., Dielectrophoresis, Cambridge University Press, 1978; Hughes, M. R., Electrophoresis, 23, 2569 (2002); Gascoyne and Vykoukal, Electrophoresis, 23, 1973 (2002); Tsukahara, Sakamoto and Watarai, Langmuir, 16, 3866 (2000); Chou, F-C et al., Biophysical Journal, 83, 2170 (2002); and Gomez, R., Bashir, R et al Biomedical Microdevices, 3:3, 201 (2001), the entire contents and disclosures of these articles are hereby incorporated by reference herein.

Embodiments of the present invention, unlike conventional approaches, provides for the use of a continuous wire to generate the particle transport mechanisms of dielectrophoresis and fluid convection. The purpose of the particle manipulation is typically to enable fast separations and selective concentration of particles, although there are other uses as well. The device and method that may be used for rapid particle transportation, separation, focusing, characterization and release are described herein.

In accordance with certain embodiments of the present invention, a device is provided having three physical components, a continuous wire 100, a medium 102 in contact with wire 100 and an AC source 104 in electrical communication with wire 100. Medium 102 is less conductive than wire 100. In alternative embodiments, medium 102 is nonconductive. A fluid is provided in contact with the wire 100 and the medium 102. The fluid contains particles that are to be manipulated and/or characterized and may comprise a dielectric liquid, an electrolyte or a mixture of dielectric liquids and electrolytes. When continuous wire 100 is arranged in a substantially serpentine orientation, as shown in FIG. 1, a fluid is put in contact with wire 100 and medium 102, and an AC source is turned on with a frequency between approximately 100 hertz and approximately 1 megahertz and an RMS voltage between approximately 0.1 volts and approximately 3000 volts. An electric field is generated that gives rise to an induced double layer polarization on the surface of wire 100. Although a serpentine orientation is shown in FIG. 1, other arrangements of conducting wires are also encompassed by the present invention, such as a spiral geometry.

The medium 102 is described in greater detail in co-pending U.S. patent application Ser. No. 10/965,781, entitled "Method and Apparatus for AC Micropump," filed Oct. 18, 2004, noted above.

In a serpentine orientation of a wire, there are a series of bends 106 and straights 108. Straights 108 are the typically longer portions of wire 100, and are substantially perpendicular to fluid flow. Bends 106 connect straights 108 together and may create right angles with the straights, may be curved, or may be in any configuration so long as wire 100 is continuous. Straights 108 may be spaced apart by a distance D which is in this illustrative embodiment approximately 10 nanometers to approximately 3 centimeters. In one embodiment of the present invention, straights 108 form a sequential series of substantially parallel and aligned regions of wire 100.

Since AC source 104 may also create a non-uniform field, polarizable particles in the fluid will be transported or held stationary via a dielectrophoretic force. Additionally, a transverse electric field across continuous wire 100 in FIG. 1 exerts a net Maxwell force on a induced double layer, leading to fluid recirculation that rapidly transports particles via convection.

Faradaic reactions are essentially eliminated in such a wire configuration because most of the electric field and current are confined to wire 100 and not to the fluid. Because of this, one is able to generate much higher potential gradients (~$10^6$ V/m) than conventional disjointed electrode configurations. Thus, it is possible to produce much higher convective transport velocities (~10 cm/sec). The AC frequency ranges from approximately 100 hertz to approximately 10 megahertz.

Figure 2A:
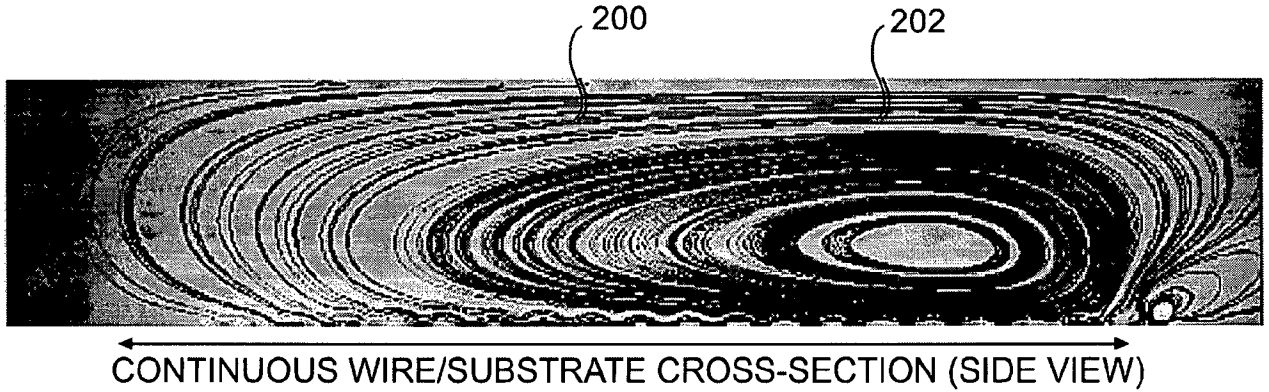
FIGS. 2A and 2B are side view illustrations of the calculated fluid streamlines that particles are convected along for an example serpentine orientation embodiment of the present invention.
Figure 2B:
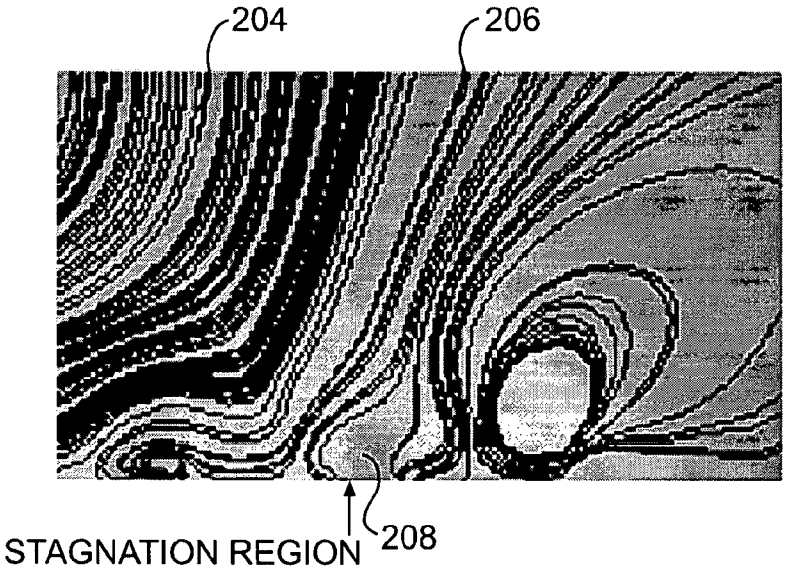

The pumping of fluid via the use of a continuous wire connected to an AC source is described in detail in Chang et al., U.S. patent application Ser. No. 10/965,781, entitled "Method and Apparatus for AC Micropump," filed Oct. 18, 2004. Microscale pumping is of greatest utility in the global transport of fluids to different regions within a chip-based diagnostic or drug delivery system. When the fluid and particle sample reaches a region of the chip where analysis is to take place, local transportation of the particles is crucial to making fast and sensitive measurements. Embodiments of the present invention provide for the local use of the device and method for a continuous wire AC micropump; previously disclosed in Chang et. al. application Ser. No. 10/965,781, to create powerful recirculation currents that may convectively transport particles and a dielectrophoretic force to transport the particles or hold them stationary. FIGS. 2A and 2B illustrate the fluid streamlines such as, streamlines 200, 202, 204 and 206 that particles are convected along for an example serpentine orientation embodiment of the present invention. FIG. 2B is an expanded view of the stagnation region 208, which for this embodiment of the present invention coincides with a region of relatively low field. As shown in FIG. 2B, the fluid travels in a counterclockwise recirculating pattern.

Figure 3:
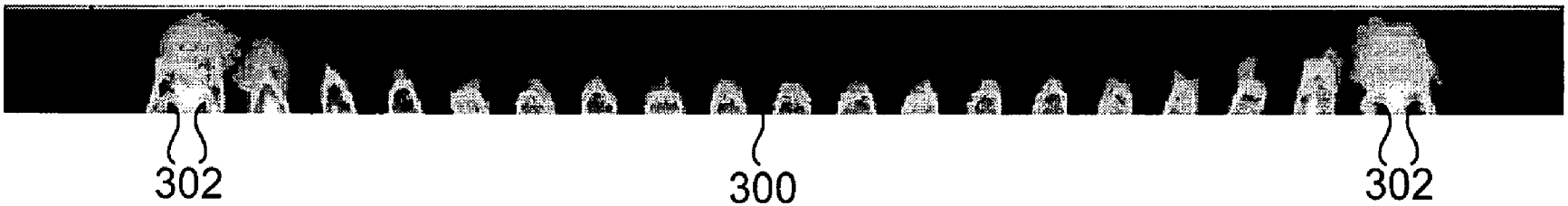
FIG. 3 is a side view illustration of the calculated spatial variation in the intensity of the electric field for an example serpentine orientation embodiment of the present invention.

The electric field generated by AC source 104 and continuous wire 100 of the present invention also acts to transport particles in a fluid. This motion is due to the phenomena of dielectrophoresis, which moves those particles with positive dielectrophoretic mobilities (pDEP) to regions of high electric field and particles with negative dielectrophoretic mobilities (nDEP) to regions of low electric field. FIG. 3 illustrates the spatial variation in the intensity of the electric field for an example serpentine orientation embodiment of the present invention. Hence, for fixed independent parameters, particles with pDEP are transported toward the continuous wire while those particles with nDEP are transported toward the low field regions on medium 102 that is in contact with wire 100. For example, regions near the wire 302 <as currently indicated> are strongest in electric field and regions 300 <as currently indicated> in the gap coinciding with bends in the wire (where medium 102 is exposed) are weakest in electric field.

Figure 4:
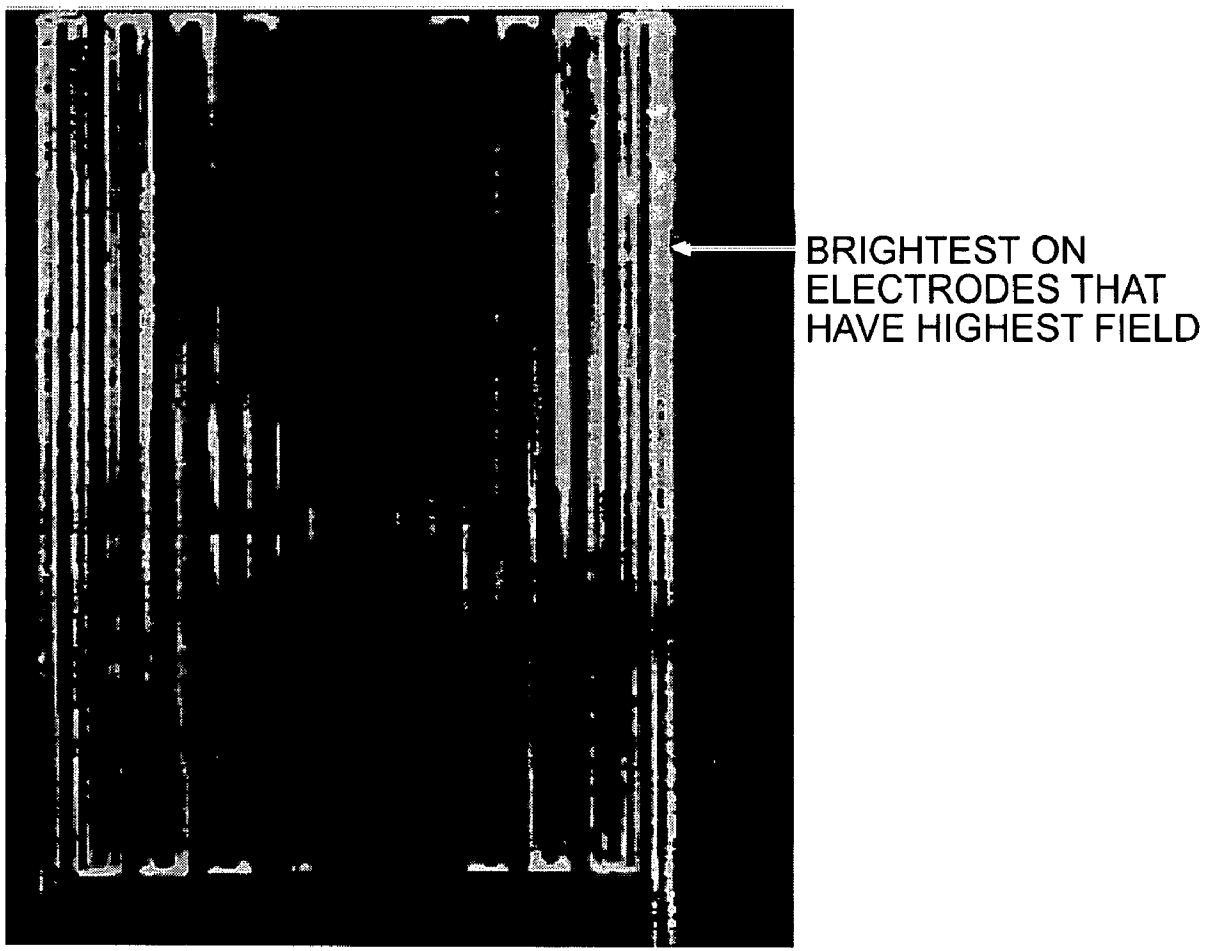
FIG. 4 shows fluorescent particles, visible as brighter regions, that have been transported to the high field regions on a continuous wire surface by pDEP, confirming the calculated spatial variation in the intensity of the electric field.

FIG. 4 illustrates fluorescent particles that have been transported to the high field regions on a continuous wire surface by pDEP.

Figure 5:
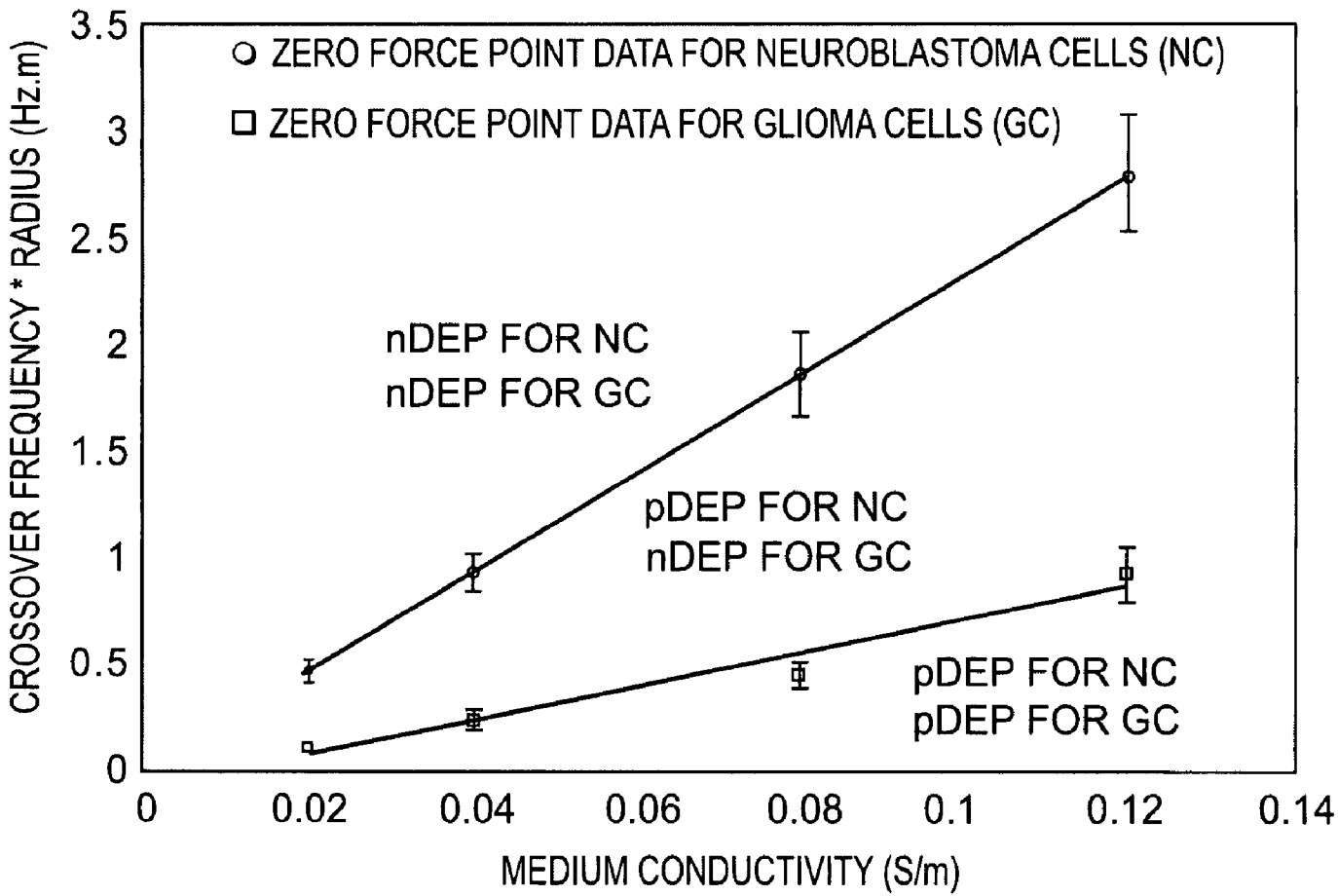
FIG. 5 PRIOR ART
FIG. 5 shows the typical ranges of AC source frequency and fluid conductivity where different particles have pDEP and nDEP.
Figure 6A:
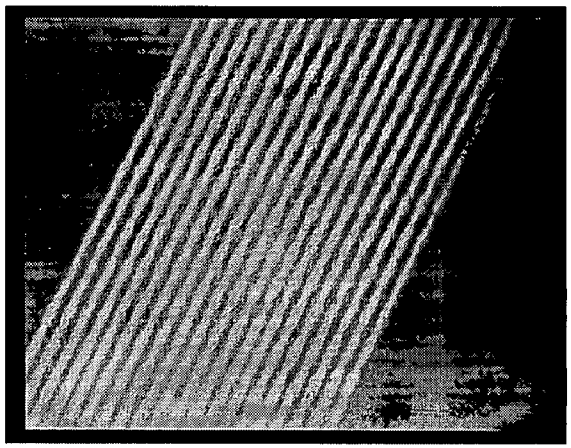
FIGS. 6A, 6B, 6C and 6D show the rapid development of a highly concentrated region using the particle focusing device and method of one embodiment of the present invention.
Figure 6B:
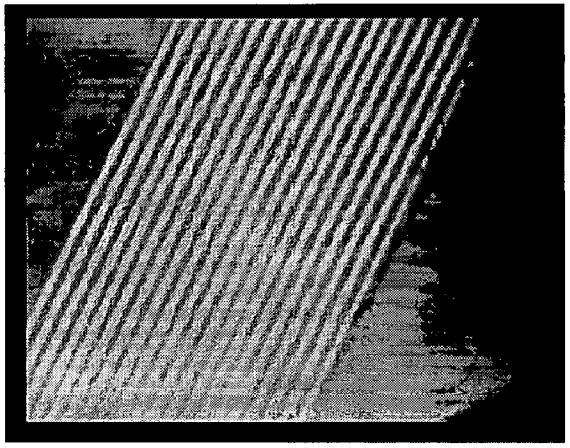
Figure 6C:
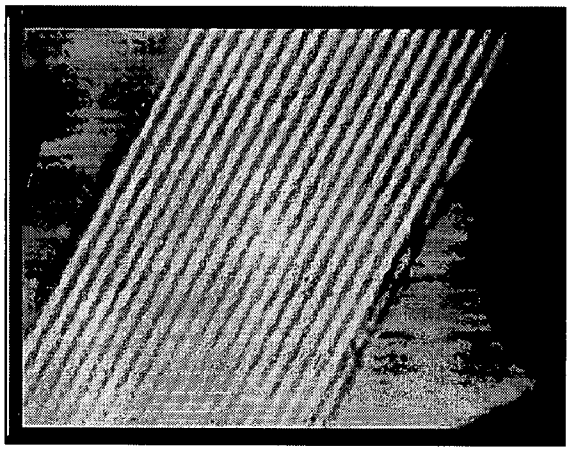
Figure 6D:
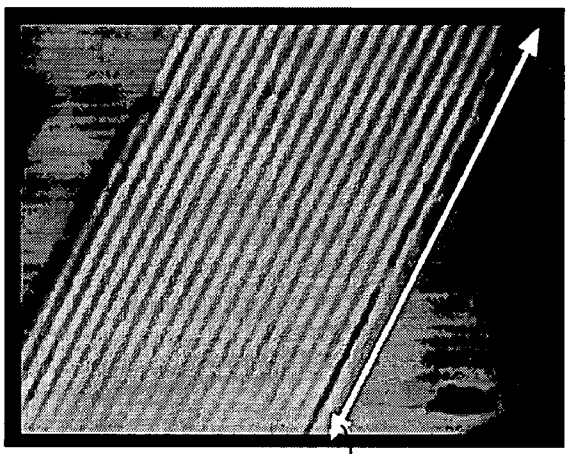

Embodiments of the present invention provide for the use of transport via pDEP and nDEP as a means for separation of particles. The zero force point varies for different types of particles, as can be seen in FIG. 5. At constant fluid conductivity, the frequency at which the particle reverses from pDEP to nDEP (or vice versa) is called the zero force point or the crossover frequency. This data is for two cells and is from Huang et. al., Anal. Chem. 74, 3362-3371, 2002, the entire contents and disclosure of which is hereby incorporated by reference. Hence, a precise separation of a target species from a complex mixture may be achieved by either using several of the devices of the present invention arranged into an array or by operating a single device in a two-step sequential batch manner.

The sequential batch procedure employs a binary separation technique twice to obtain a single target species. This is accomplished by choosing the operating parameters such that in the first step the group of particles that do not include the target species are removed. Then, the operating parameters are adjusted slightly so that only the target species falls into one bin while all of the remaining species are in the other bin and are discarded.

For example, the first step for either approach could be to choose a value for the frequency near the zero force point of the target particle. For the purposes of this example, assume that a frequency just below the zero force point is chosen. Hence, the particle will have pDEP. Next, the subset of the mixture that does not include the target species is removed. Following that, the frequency is adjusted to a value just above the zero force point of the particle. The target species is now the only species with nDEP in the system. The final step is simply removing all of the species with pDEP and keeping the target species. It should be noted that this suggested procedure may be extended to separate an arbitrary number of target species from a mixture. Also note that the most challenging steps in this process are the removal of the subsets of particles that do not include the target species.

An embodiment of the present invention is a solution to the aforenoted challenge in the form of a method to selectively focus and retain one of the binary fractions. The use of a characteristic of the fluid flow, a stagnation region, in tandem with pDEP or nDEP enables the selective focusing and retention of one of the binary fractions while the other may be pumped to the next component of the kit or to waste. This critical feature of selective focusing and retention enables sharp binary separations that may be used in an array or sequential batch manner for single or multiple target species isolation.

The present invention may provide for the use of convective transport and dielectrophoresis in tandem as a mechanism for focusing a subset of the particles in a sample mixture. As is shown in FIGS. 2A and 2B, continuous wire 100 and AC source 104 may be configured in a geometry to create a fluid flow field that has at least one stagnation region. Should the stagnation region be collocated with a region with a local or, preferably, a global extrema in AC electric field strength, then particles may be trapped at the stagnation region by dielectrophoresis. Should a stagnation region be located near the surface of continuous wire 100, then particles with pDEP will be preferentially focused at the stagnation region while particles with nDEP are rejected. Similarly, should a stagnation region be located near the surface of medium 102 in contact with wire 100, then particles with nDEP will be preferentially focused at the stagnation region while particles with pDEP are rejected. In order to illustrate this point, an apparatus of serpentine orientation illustrated in FIG. 1 with the fluid flow field shown in FIGS. 2A and 2B and the electric field of FIG. 3 was reduced to practice. Since the stagnation region coincides with medium 102 (in this case a solid substrate), a region of relatively low electric field, particles with nDEP are focused. FIGS. 6A, 6B, 6C, and 6D show the rapid development of a highly concentrated region embodiments of using the particle focusing device and method of the present invention.

The focusing of a subset of the particles in a mixture as described herein maybe advantageously employed in the rapid and sensitive characterization of their chemical, physical, physicochemical, and biological properties. One example is using differences in the impedance spectra as a metric for the number of particles that are focused at the stagnation region at a particular point in time. Another example is to reduce (increase) the frequency of AC source 104 until a target particle is captured (rejected) from the stagnation point to determine its zero force point. Measurement of the zero force point of a target particle has uses ranging from determining optimal independent parameters for dielectrophoretic separations of mixtures that include the target particle to calculation of the zeta potential of the target particle. In fact, numerous detection and measurement techniques including but not limited to impedance, immunoassays, electrorotation, and fluorescence may be integrated with the present invention to take advantage of the highly focused subsets of particles for rapid and sensitive detection, quantification and characterization.

Following the characterization of the focused subset of particles, it is desirable to release the focused particles from the stagnation region. For example, after release a subset of particles may be pumped to the next step on a chip based diagnostic. Concurrently, the next subset may be rapidly transported to the stagnation region, focused, and analyzed. The ability to release a focused subset of particles advantageously enables reuse by sweeping all of the focused particles away from the stagnation region.

The mechanism that embodiments of the present invention may use for release of focused particles is the changing of the independent parameters in such a way that the particles are rejected from the stagnation region that they have come to rest on. One such method is to change the fluid flow field in such a manner that the stagnation region is eliminated.

An alternative method for the release of particles from a stagnation region is the elimination or, preferably, the reversal of the force that aids in holding the subset of particles stationary. For example, if the trapping force is dielectrophoresis, a simple change to the frequency of AC source 104 may be used to cause the focused subset of particles to pass their zero force point. As FIG. 5 illustrates, when a particle crosses its zero force point its dielectrophoretic mobility changes from positive to negative or vice-versa. Although the dielectrophoretic mobility of the subset of particles will have reversed, the stagnation region will remain of relatively low electric field if it is near the substrate and of relatively high electric field if it is near the continuous wire.

Hence, upon reversal of their dielectrophoretic mobility, a subset of particles that had been held stationary by dielectrophoresis will instead be rejected from the stagnation region. FIGS. 7A, 7B, 7C and 7D show the rapid release of a subset of particles focused to a highly concentrated region by reversal of their dielectrophoretic mobility using the device and method of the present invention.

Reasonable ranges for independent parameters such as AC source frequency and voltage, continuous wire spacing for a serpentine orientation, and material choice for the wire, medium, and fluid that are embodiments of the present invention are reported. They are based upon theory and empirical observations. Although an exhaustive set of reasonable independent parameters is outside of the scope of this document, these key values are reported as they form a fundamental basis for the proper operation of an embodiment of the present invention that has been reduced to practice.

Figure 8:
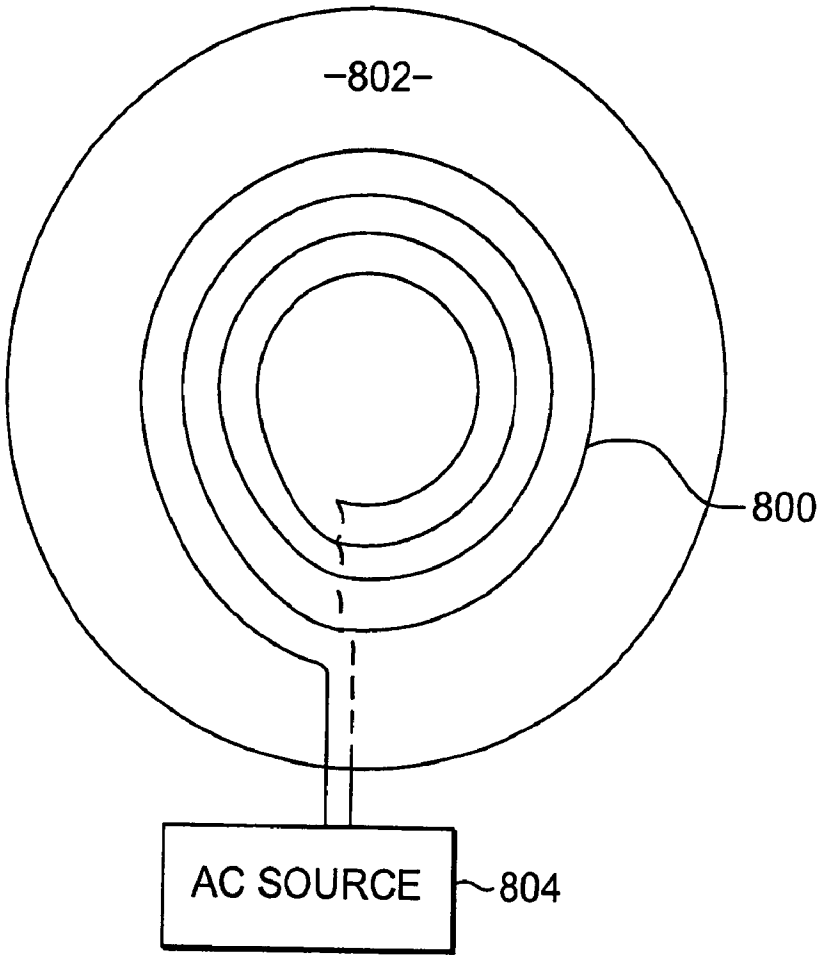
FIG. 8 shows a continuous wire with a spiral orientation in accordance with an embodiment of the present invention.

The fluid that contains the particles that are to be manipulated and/or characterized may comprise a dielectric liquid, an electrolyte, or a mixture of dielectric liquids and electrolytes. The AC source should operate in at least part of the ranges in frequency from 100 hertz to 10 megahertz and in RMS voltage from approximately 0.1 volts to approximately 3000 volts, with the specific frequency and RMS voltage chosen depending on other independent parameters and the desired particle manipulation and characterization. The continuous wire may be partially coated with a dielectric film. The continuous wire may be partially covered with packing, porous media, or monoliths having pore sizes from approximately 1 nanometer to approximately 10 micrometers. The continuous wire may be arranged in a spiral orientation as illustrated in FIG. 8. The device of FIG. 8 has three physical components: a continuous wire 800, a medium 802 in contact with wire 800 and an AC source 804 in electrical communication with wire 800. The medium in contact with the wire should be less conductive than the wire or nonconductive, and it may comprise a solid substrate to which the continuous wire is affixed, a fluid, or a combination of one or more substrates with one or more fluids.

Based on the foregoing, it is seen that the method and device of the present invention may be used for various applications including manipulation and characterization of proteins, bacteria, cells, viruses, DNA, or colloids ranging from approximately 10 nanometers to approximately 100 micrometers in diameter. For example, the present invention may be used to increase the speed and sensitivity of a diagnostic that is detecting a potentially dangerous pathogen. A more specific example of how an embodiment of the present invention could be used for characterization of particle is the optical observation of the effect of the AC source, continuous wire, and medium on the fluid. An additional specific example metric for characterization of particles is the measurement of the impedance of a circuit comprised of a portion of the wire and the fluid. For microbe diagnostic applications, such impedance signals may quantify the total number of bacteria, identify specific bacteria and determine whether the bacteria are viable (alive). By repeatedly passing different antibiotic solutions over multiple trapped bacteria populations and by measuring the impedance spectra after each rinse, highly specific identification and viability tests may be achieved rapidly in a combinatorial fashion. Incubation and heating, in combination with the above antibiotic screening, may selectively amplify the signal through the selective growth of a target bacteria species thus further enhancing the sensitivity of the device.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. A device for rapid particle transportation, separation, focusing, characterization, and release comprising:

a continuous conducting wire;

a medium in contact with said conducting wire, said medium being less conductive than said wire;

a source electrically connected via at least two leads with said wire and for generating an alternating current across said continuous conducting wire so that said continuous conducting wire creates an electric field for transporting, separating, focusing, characterizing and/or releasing particles contained in said medium, wherein said source is electrically connected to said continuous conducting wire but is not further connected to any other conductive material and generates a frequency between approximately 100 hertz and approximately 10 megahertz, inclusive, and an RMS voltage between approximately 0.1 volts and approximately 3000 volts.

2. The device of claim 1, wherein said continuous conducting wire comprises a series of bends and straights, wherein at least two of said straights are substantially parallel to each other.

3. The device of claim 2, wherein said substantially parallel straights are spaced apart by between 10 nanometers and 3 centimeters.

4. The device of claim 1, wherein said continuous conducting wire is at least partially coated with a dielectric film.

5. The device of claim 1, wherein said wire is at least partially covered with packing, porous media, or monoliths having pore sizes from approximately 1 nanometer to approximately 10 micrometers.

6. The device of claim 1, wherein said medium comprises a substrate to which said wire is affixed.

7. The device of claim 1, wherein said medium comprises a fluid.

8. The device of claim 1, wherein said medium comprises a combination of one or more substrates with one or more fluids.

9. A method for rapid particle transportation, separation, focusing, characterization, and or release comprising:

providing a continuous conducting wire;

providing a medium in contact with said continuous conducting wire that is less conductive than said wire;

providing a fluid in contact with said continuous conducting wire and said medium; and applying an alternating current across said continuous conducting wire with via a source electrically connected to the continuous conducting wire by at least two leads with a frequency between approximately 100 hertz and approximately 10 megahertz, inclusive and an RMS voltage between 0.1 volts and 3000 volts, inclusive so that said continuous conducting wire creates an electric field for transporting, separating, focusing, characterizing and/or releasing particles contained in said medium wherein the source is not connected to any other conductive material.

10. The method of claim 9, wherein said continuous conducting wire is arranged in a serpentine configuration.

11. The method of claim 10, wherein said continuous conducting wire comprises a series of bends and straights, wherein at least two of said straights are substantially parallel to each other.

12. The method of claim 11, wherein said substantially parallel straights are spaced apart by between 10 nanometers to 3 centimeters.

13. The method of claim 9, wherein said continuous conducting wire is arranged in a spiral configuration.

14. The method of claim 9, wherein said continuous conducting wire is at least partially coated with a dielectric film.

15. The method of claim 9, wherein said continuous conducting wire is at least partially covered with packing, porous media, or monoliths having pore sizes from 1 nanometer to 10 micrometers.

16. The method of claim 9, wherein said fluid comprises a dielectric liquid, an electrolyte or a mixture of dielectric liquids and electrolytes.

17. The method of claim 9, wherein said fluid comprises proteins, bacteria, cells, viruses, DNA, or colloids ranging from 10 nanometers to 100 micrometers in diameter.

18. The method of claim 9, wherein optical observation of the effect of said AC source, said continuous conducting wire, and said medium on said fluid is used as a metric for characterization of a part of said fluid.

19. The method of claim 9, wherein impedance of a circuit comprised of a portion of said continuous conducting wire and said fluid is used as a metric for characterization of a part of said fluid.

20. The method of claim 9, wherein said less conductive or nonconductive medium comprises a substrate to which said continuous conducting wire is affixed.

21. The method of claim 9, wherein said medium comprises a second fluid.

22. The method of claim 9, wherein said medium comprises a combination of one or more substrates with one or more fluids.

23. The method of claim 9, wherein said alternating current creates a non-uniform field, and wherein polarizable particles are held stationary by a dielectrophoretic force.

24. The method of claim 9, wherein said alternating current creates a transverse electric field across said continuous conducting wire that exerts a net Maxwell force that rapidly transports particles via convention.

25. The method of claim 9, further comprising the step of focusing a first subset of particles in a mixture of particles by generating a stagnation region and holding said first subset of particles stationary within said stagnation region.

26. The method of claim 25, further comprising the step of releasing said first subset of particles from said stagnation region and transporting said released particles.

27. The method of claim 25, further comprising the step of pumping a second subset of particles to a predetermined region, while said first subset of particles is in said stagnation region.

28. The method of claim 27, further comprising the step of focusing a third subset of particles in said mixture of particles by generating a stagnation region and holding said third subset of particles stationary within said stagnation region while transporting particles that are outside of said stagnation region.

29. The method of claim 25, further comprising the step of characterization of properties of said first subset of particles.

30. The method of claim 29, wherein said characterization comprises the determination of at least one of their chemical, physical, physicochemical or biological properties.

31. The method of claim 30, wherein said first subset of particles are subject to a detection and measurement technique selected from the group consisting of impedance, immunoassays, electrorotation, and fluorescence.

32. The method of claim 25, further comprising the step of detecting a subset of particles within said mixture of particles.

33. The method of claim 25, further comprising the step of quantifying a subset of particles within said mixture of particles.

34. The method of claim 26, comprising the step of pumping said released subset of particles to a next step on a chip based diagnostic.

35. The method of claim 26, wherein said first subset of particles are released by changing at least one independent parameter such that said first subset of particles are released from said stagnation region.

36. The method of claim 35, wherein the fluid flow field is changed such that the stagnation region is eliminated.

37. The method of claim 35, wherein said first subset of particles are released by reversing, eliminating or reducing the force that focuses said first subset of particles in said stagnation region.

38. The method of claim 9, wherein said frequency of said alternating current is varied until a subset of particles are captured within a stagnation region.

39. The method of claim 9, wherein said frequency of said alternating current is varied until a subset of particles are released from a stagnation region.

40. A method for focusing a first subset of particles within a mixture of particles, comprising:

providing a continuous conducting wire;

providing a medium in contact with said continuous conducting wire that is less conductive than said wire;

providing a fluid in contact with said continuous conducting wire and said medium; and a first focusing step comprising: applying an alternating current across said continuous conducting wire via a source electrically connected to the continuous conducting wire by at least two leads with a frequency between approximately 100 hertz and approximately 10 megahertz and a RMS voltage between approximately 0.1 volts and approximately 3000 volts so that said continuous conducting wire creates an electric field that focuses a first subset of particles within a first region of said fluid wherein the source is not connected to any other conductive material.

41. The method of claim 40, further comprising the step of applying at least a second focusing step to said first subset of particles under operating conditions that differ from said first focusing step.

42. The method of claim 40, comprising the step of releasing said first subset of particles from said first region and removing said first subset of particles from said first region, applying at least a second focusing step to said mixtures of particles from which said first subset of particles have been removed, said second focusing step being under operating conditions that differ from said first focusing step.

43. The method of claim 40, wherein said mixture of particles is subjected to sequential batch processing.

44. The method of claim 43, wherein said sequential batch process comprises separating subsets of particles within said mixture of particles, in a plurality of sequential steps under a plurality of different operating conditions.

45. The method of claim 42, wherein said first focusing step removes a subset of particles that do not include a target subset, and wherein a second focusing step is operated at different operating parameters whereby said target subset of particles is focused.

* * * * *